US009837225B2

(12) United States Patent
Grange et al.

(10) Patent No.: US 9,837,225 B2
(45) Date of Patent: Dec. 5, 2017

(54) ELECTRICAL PUSHBUTTON SNAP SWITCH

(71) Applicant: C&K Components S.A.S., Dole (FR)

(72) Inventors: Eric Grange, Damparis (FR); Jean-Christophe Villain, Dole (FR)

(73) Assignee: C&K Components S.A.S., Dole (FR)

( * ) Notice: Subject to any disclaimer, the term of this patent is extended or adjusted under 35 U.S.C. 154(b) by 175 days.

(21) Appl. No.: 14/963,781

(22) Filed: Dec. 9, 2015

(65) Prior Publication Data

US 2016/0163478 A1 Jun. 9, 2016

(30) Foreign Application Priority Data

Dec. 9, 2014 (EP) ..... 14196882

(51) Int. Cl.

| | |
|---|---|
| ***H01H 1/00*** | (2006.01) |
| ***H01H 9/00*** | (2006.01) |
| ***H01H 13/26*** | (2006.01) |
| ***H01H 13/14*** | (2006.01) |
| ***H01H 13/32*** | (2006.01) |

(Continued)

(52) U.S. Cl.

CPC ..... *H01H 13/26* (2013.01); *H01H 13/14* (2013.01); *H01H 13/32* (2013.01); *H01H 1/26* (2013.01); *H01H 3/42* (2013.01); *H01H 2205/002* (2013.01)

(58) Field of Classification Search

CPC ..... H01H 1/221; H01H 1/365; H01H 1/26; H01H 13/30; H01H 13/26; H01H 13/24; H01H 13/32; H01H 3/42; H01H 2205/002; H01H 3/00; H01H 3/02; H01H 3/12; H01H 5/00; H01H 5/04; H01H 13/00; H01H 13/02; H01H 13/14; H01H 13/20; H01H 13/22; H01H 13/28; H01H 13/36; H01H 13/50; H01H 13/78; H01H 13/79; H01H 2003/00; H01H 13/12; H01H 2203/02

USPC ..... 200/271, 400, 409, 416, 417, 428, 431, 200/451, 457, 468, 329, 341, 410, 411, 200/529, 533–535

See application file for complete search history.

(56) References Cited

U.S. PATENT DOCUMENTS 2,509,194 A * 5/1950 Thorsheim ..... H01H 13/28 200/451
2,779,835 A * 1/1957 Russell ..... H01H 13/30 200/16 A (Continued)

FOREIGN PATENT DOCUMENTS

EP 0449058 A2 10/1991

*Primary Examiner* — Anthony R. Jimenez
(74) *Attorney, Agent, or Firm* — Fox Rothschild LLP

(57) ABSTRACT

An electrical snap on switch includes a pair of associated contact elements, the contact elements include a fixed contact element and a movable contact element arranged facing the fixed contact element and that may come into contact with the fixed contact element for establishing a first conductive path. The snap on switch may also include a snap-action switching device that includes a tilting driving member pivotally mounted around a horizontal axis between an upper position and a lower position. The movable contact element is a movable portion of an elastically deformable conductive blade. The driving member includes a cam, which cooperates with a cam follower portion of the blade to deform or relax the blade, to cause the movable contact to come into contact, or out of contact, with the fixed contact element, therefore to realize switching.

20 Claims, 13 Drawing Sheets

(51) Int. Cl.
*H01H 1/26* (2006.01)
*H01H 3/42* (2006.01)

(56) References Cited

U.S. PATENT DOCUMENTS 5,459,295 A * 10/1995 Ohta ..... H01H 1/58
200/244
2013/0068600 A1 3/2013 Geppert et al.

* cited by examiner

ELECTRICAL PUSHBUTTON SNAP SWITCH

RELATED APPLICATIONS

This application claims priority to European Patent Application No. 14196882.6, filed Dec. 9, 2014, the contents of which are incorporated herein by reference in its entirety.

BACKGROUND

This disclosure relates to an electrical switch and particularly to an electrical snap switch.

Existing snap switch designs generally include a conductive unit that is fixed with respect to the housing and that includes fixed contacts. For example, U.S. Pat. No. 7,205,496 discloses a switch, which includes a spring that is a helicoidally wounded traction spring and in which the pushbutton driving portion acts on the middle section of the spring.

An attempt to improve the working of such a snap switch is disclosed in U.S. Pat. No. 6,255,611. According to such an arrangement, when an external force is applied to the pushbutton, a jointed end of the driving portion of the pushbutton and the elastic spring is forced to move downwards until it passes a critical line, at which point the swaying element is coupled with another conductive fixed contact to supply power or electrical signals. However, the changeover speed remains insufficient and no solution is provided for a "double" or "twin" design for selectively establishing simultaneously two first conductive ways. This design is also generating significant impact or noises between the fixed and movable contacts, such noises are often not acceptable, for instance, when the switch is located in the interior of a vehicle.

Other improvements, such as U.S. Patent Application Publication No. 2013/0068600 and European Patent Application No. EP2151839, disclose swaying conductive element that has sliding movable contacts moving in a vertical plane.

The drawbacks in all the above mentioned designs are that the number of components is important, and that the design of the swaying conductive element or body is very complex and does not permit any variations in the design, especially concerning the number of switching conductive ways to be established or interrupted.

This document describes methods and devices that are directed to solving at least some of the issues described above.

SUMMARY

In an embodiment, an electrical snap switch includes a housing that has a receiving portion, a pushbutton having a lower portion disposed in the housing and an upper portion extending out of the housing. The pushbutton includes an actuating portion laterally extending from the lower portion of the pushbutton. The pushbutton is arranged such that it moves vertically relative to the housing when an external force is applied to the pushbutton. In one embodiment, the switch also includes at least a pair of associated contact elements placed in the receiving portion. The pair of associated contact elements includes: a fixed contact element placed in the receiving portion, and a movable contact element facing the fixed contact element and configured to come into contact with the fixed contact element for establishing a conductive path between the movable contact element and the fixed contact element. The switch also includes a snap-action switching device placed in the housing. The switching device includes a tilting driving member pivotally mounted at a pivotal end to the housing around a horizontal axis, whereas the pivoting axis is fixed with respect to the housing. The switching device also includes a traction spring extending longitudinally and having one end hooking to the driving member distal to the pivotal end, and configured to pivot the driving member between an upper position and a lower position by the actuating portion of the pushbutton when the pushbutton moves vertically relative to the housing. In one embodiment, the movable contact element is a movable portion of an elastically deformable conductive blade supported by the housing. The driving member includes a cam configured to cooperate with a cam follower portion of the blade to deform or relax the blade transversely to cause the movable contact element to come into contact or release from contact with the fixed contact element, therefore to realize switching.

In another embodiment, additional pairs of contact elements can be provided, and the driving member can have additional cams configured to cooperate with additional blades to realize switching at multiple contact points. In another embodiment, dampening abutment devices can be used at upper or lower positions when the driving member moves pivotally. The dampening devices can be individual dampening blocks or integrated into one piece that fits between the housing and housing upper cover.

The traction spring inside the snap on switching device can be configured to move the driving member in various ways. For example, the traction spring can be hooked between a pivotal point about which the driving member pivotally moves and a hook point on the pushbutton. In another embodiment, the traction spring can be hooked between the pivotal point and the interior side of the housing.

DETAILED DESCRIPTION

As used in this document, the singular forms "a," "an," and "the" include plural references unless the context clearly dictates otherwise. Unless defined otherwise, all technical and scientific terms used herein have the same meanings as commonly understood by one of ordinary skill in the art. As used in this document, the term "comprising" means "including, but not limited to."

In the description that follows, identical, similar or analogous components are designated by the same reference numbers.

As a non-limiting example, to assist in understanding the description and the claims, the terms vertical, horizontal, bottom, top, up, down, transversal, longitudinal, and so on will be adopted with reference to the L, V, T trihedron indicated in the figures, and without any reference to the gravity.

Figure 3:
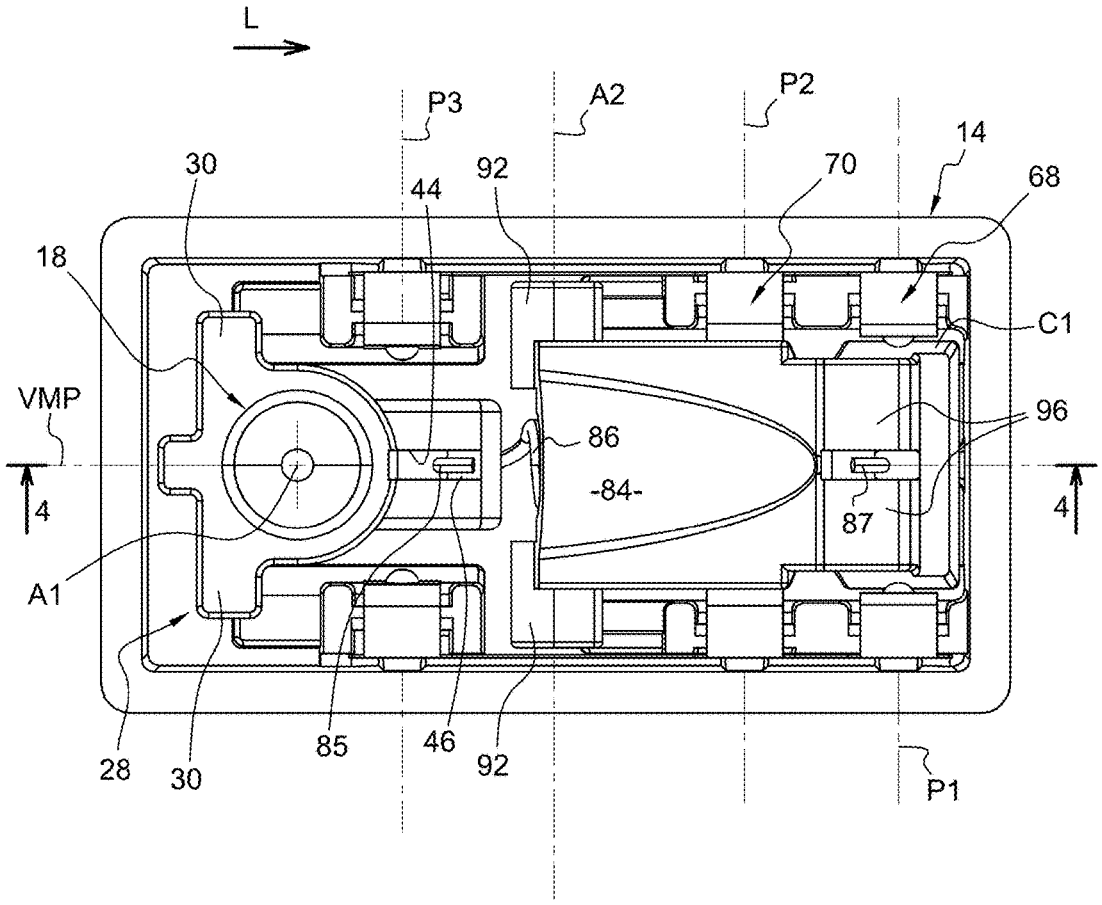
FIG. 3 is a top view of the lower part of the housing of the snap switch and inside components according to one embodiment.

In the illustrated embodiment, the design of the whole switch is symmetrical with respect to the vertical median plane VMP corresponding to line 4-4 of FIG. 3.

Figure 1:
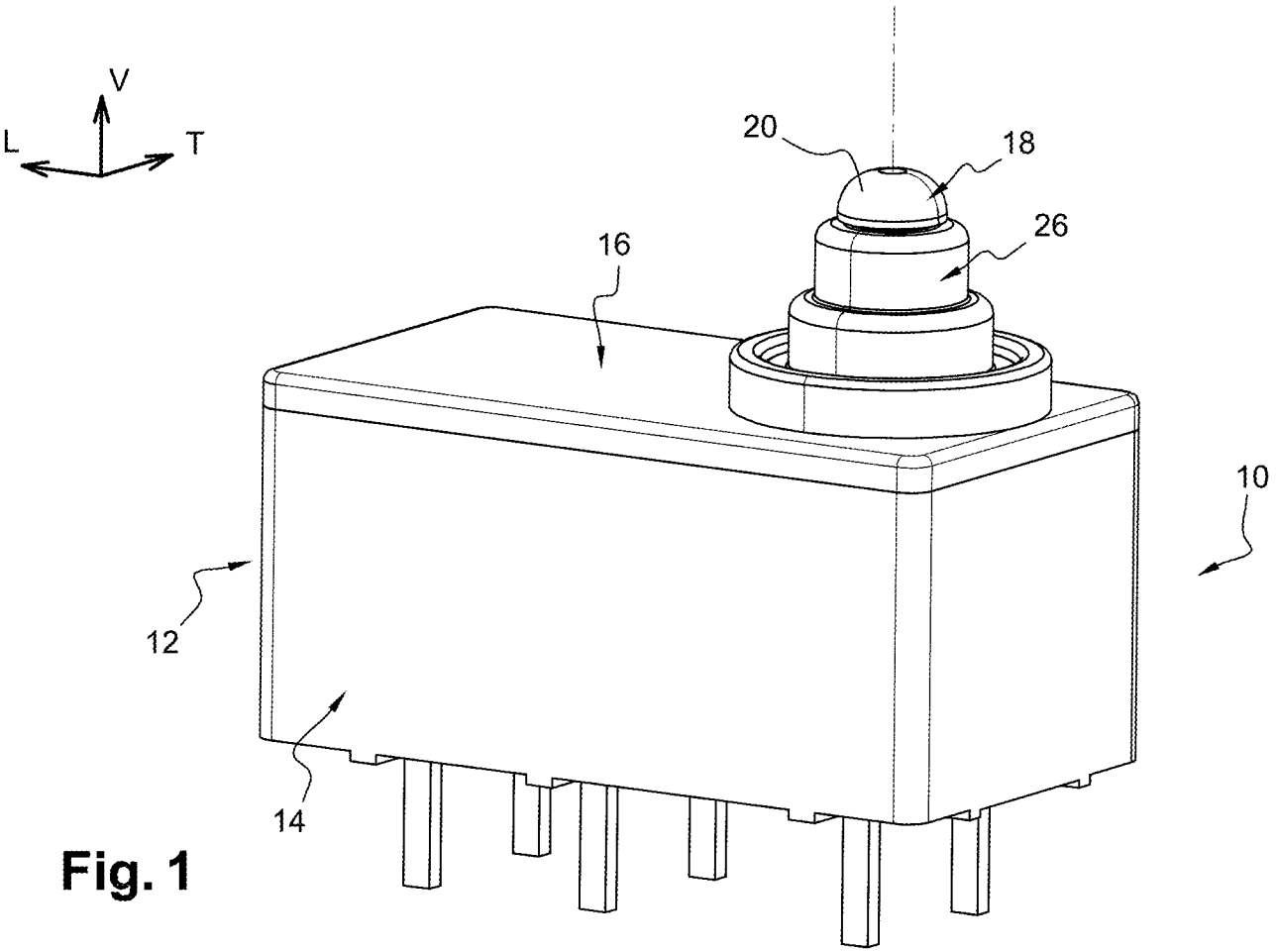
FIG. 1 is a top perspective view which illustrates an embodiment of a bistable snap switch according to one embodiment.

With reference to FIG. 1, in one embodiment, a snap switch 10 may include a housing 12, of rectangular parallelepipedic shape, and the housing may include a housing upper cover part 16 and a housing lower part or half 14—defining a receiving portion—made of moulded plastics and which might be ultrasonic welded after mounting and assembly.

The switch 10 may further comprise a vertically extending and displaceable pushbutton 18 having a free upper end 20 for receiving an actuation force. The main vertical upper stem 22 (FIG. 2) of the pushbutton 18 extends through a hole 24 of the housing upper cover part 16 in combination with a sealing boot 26.

Figure 2:
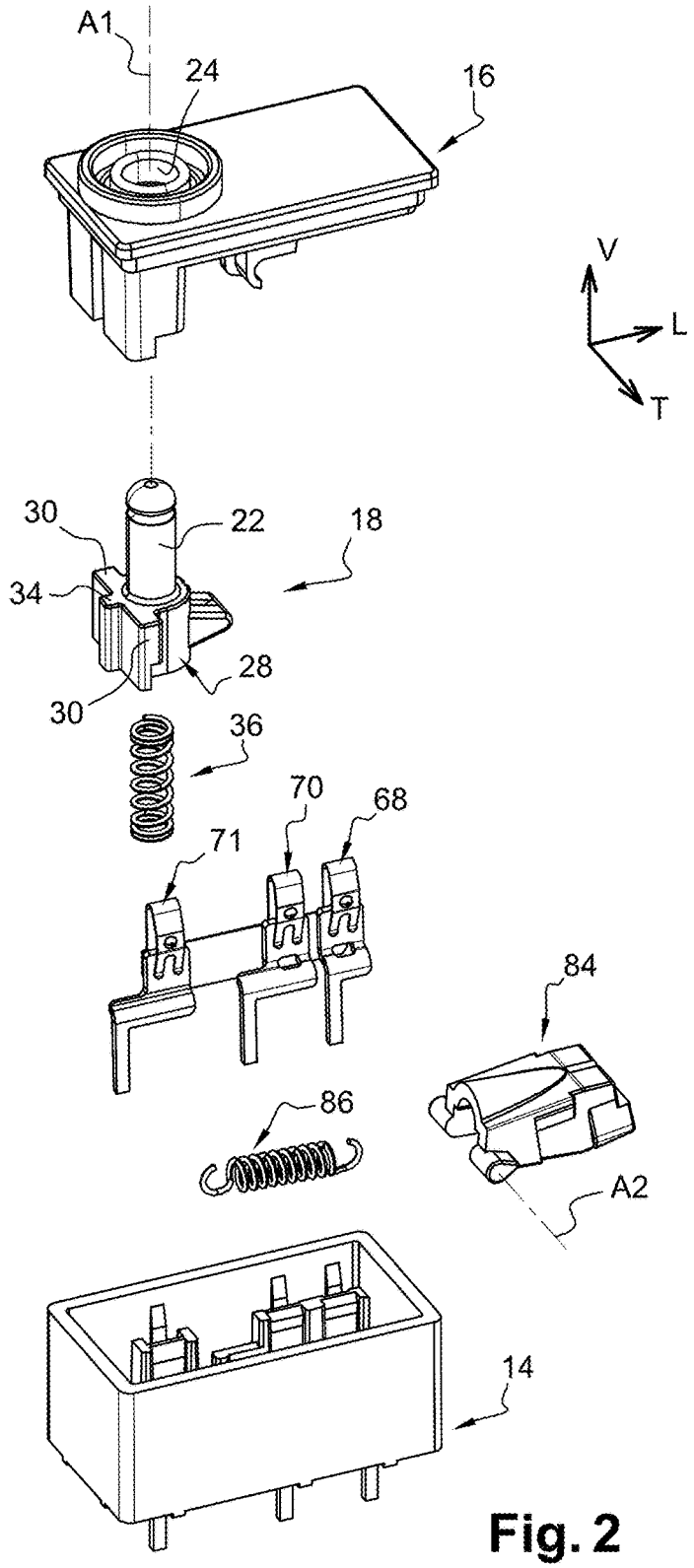
FIG. 2 shows some of the components of FIG. 1 in an exploded view.
Figure 12:
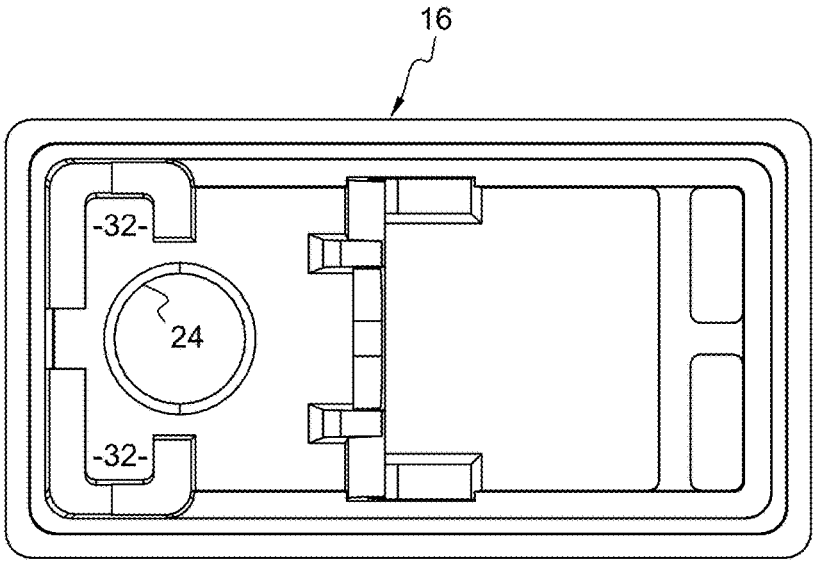
FIG. 12 is bottom view of the upper cover part of the housing according to one embodiment.

With reference to FIG. 2, the pushbutton 18 is, in a non-limiting manner, a plastic moulded part comprising a lower actuating portion 28, which is an extension of the main vertical stem 22 and which is arranged and extends inside the housing 12. The lower actuating portion 28 comprises a pair of vertically and transversely extending lateral guiding wings 30, which are received in mating and complementary pairs of vertical grooves 32 (FIG. 12), which are arranged in the upper cover part 16 of the housing 12. The pushbutton is thus guided vertically with respect to the housing 12 along a vertical actuation axis A1.

The switch 10 may further comprise a return spring 36 disposed vertically between the lower part 14 of the housing 12 and the lower actuating portion 28 of the pushbutton 18. The return spring 36 is a vertically and helicoidally wounded spring, which is received in a pit 40 of the lower part 14 and has its upper end acting on an internal horizontal face 42 of the actuating portion 28 (FIG. 4).

Figure 4:
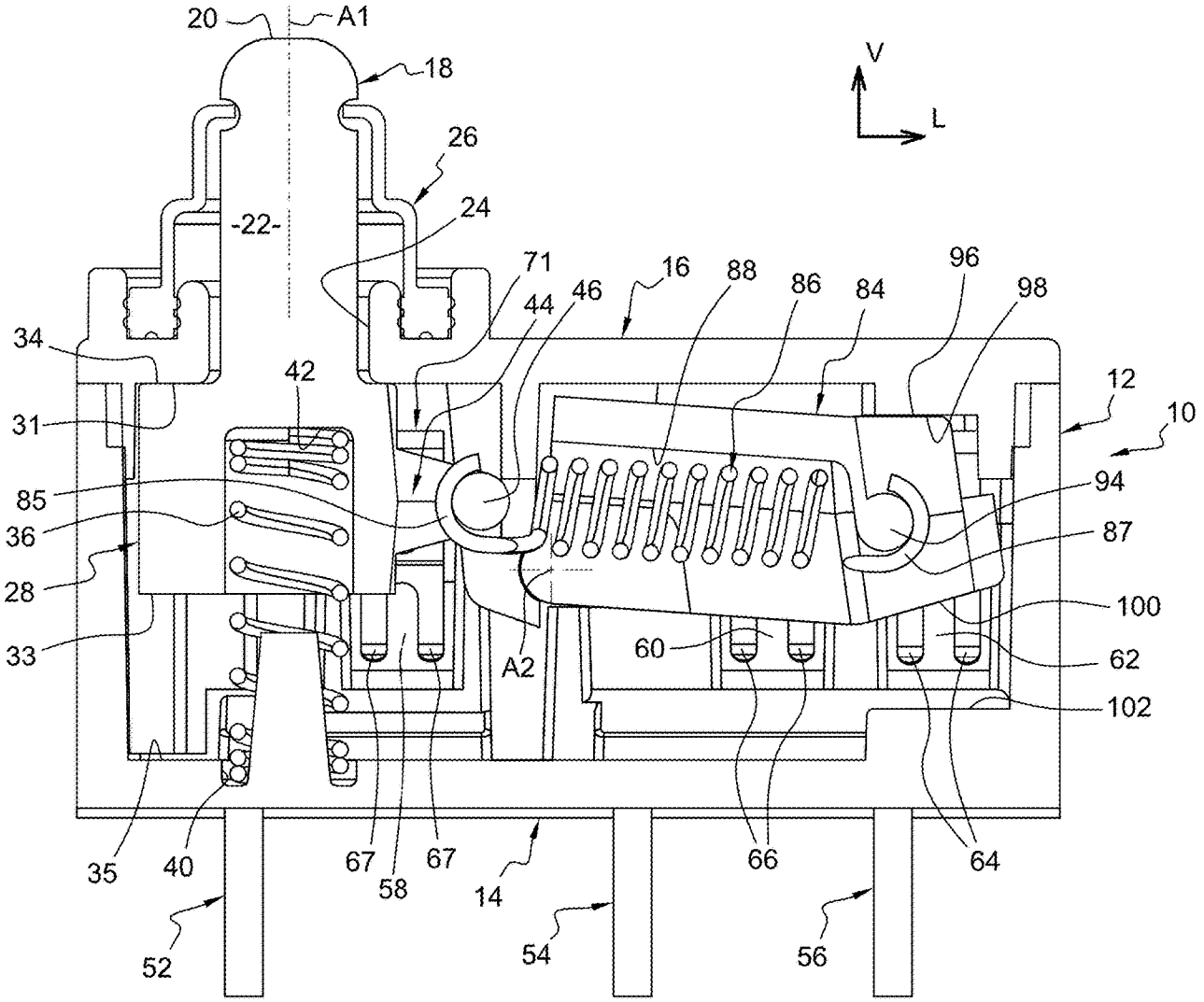
FIG. 4 is a cross-sectional view taken along line 4-4 of FIG. 3 showing the components in their upper position.
Figure 5:
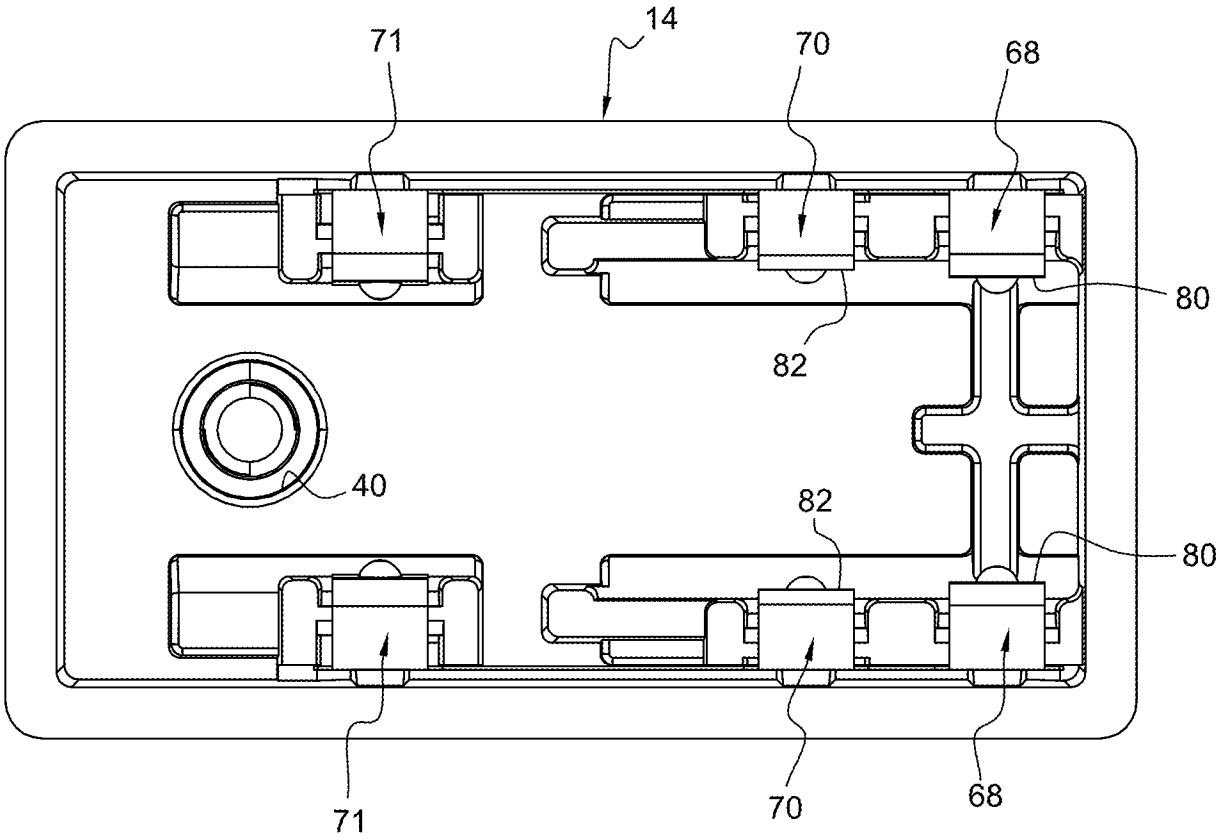
FIG. 5 is a top view of the lower part of the housing of the snap switch without the inside components.
Figure 6:
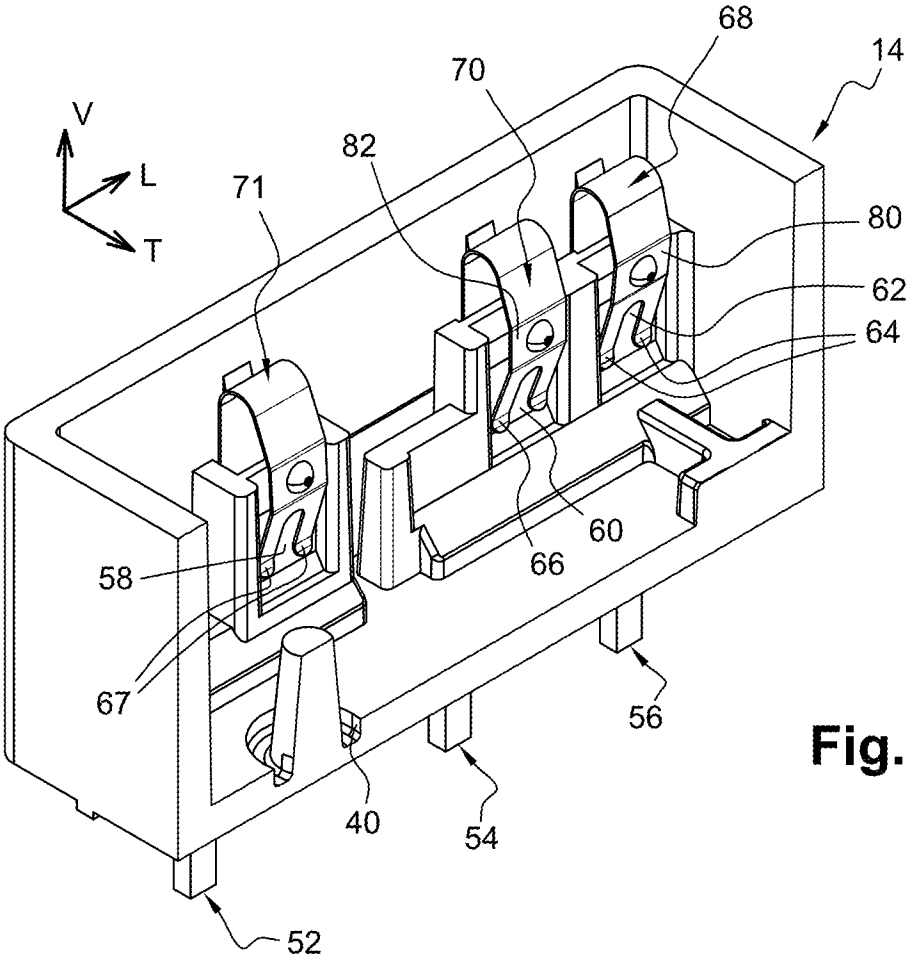
FIG. 6 is a half perspective view of the lower part of the housing of FIG. 2.

With reference to FIG. 4, the return spring 36 is mounted so as to be vertically compressed in such a way that, when an external force that is applied downwardly to the free upper end 20 of the pushbutton is removed, the pushbutton is returned back to its upper rest position by the return spring 36. This upper rest position is defined by the cooperation of an upper face 34 of the actuating portion 28 with a lower facing face 31 of the upper cover part 16. Starting from this upper position, and by compressing the return spring 36, the pushbutton 18 can be pushed downwardly towards its extreme lower position, which is defined by the cooperation of a lower face 33 of the actuating portion 28 together with a facing portion 35 of the lower housing part 14.

The lower actuating portion 28 comprises a vertically open slit 44. The slit 44 is delimited longitudinally by a transversal stem shaped portion 46 for constituting, in this example, a spring hooking portion. The pushbutton 18 is longitudinally arranged at one end of the housing 12 and the actuating portion 28 extends longitudinally towards the other opposite end of the housing 12, having its portion 46 oriented longitudinally towards said other opposite end.

Figure 7:
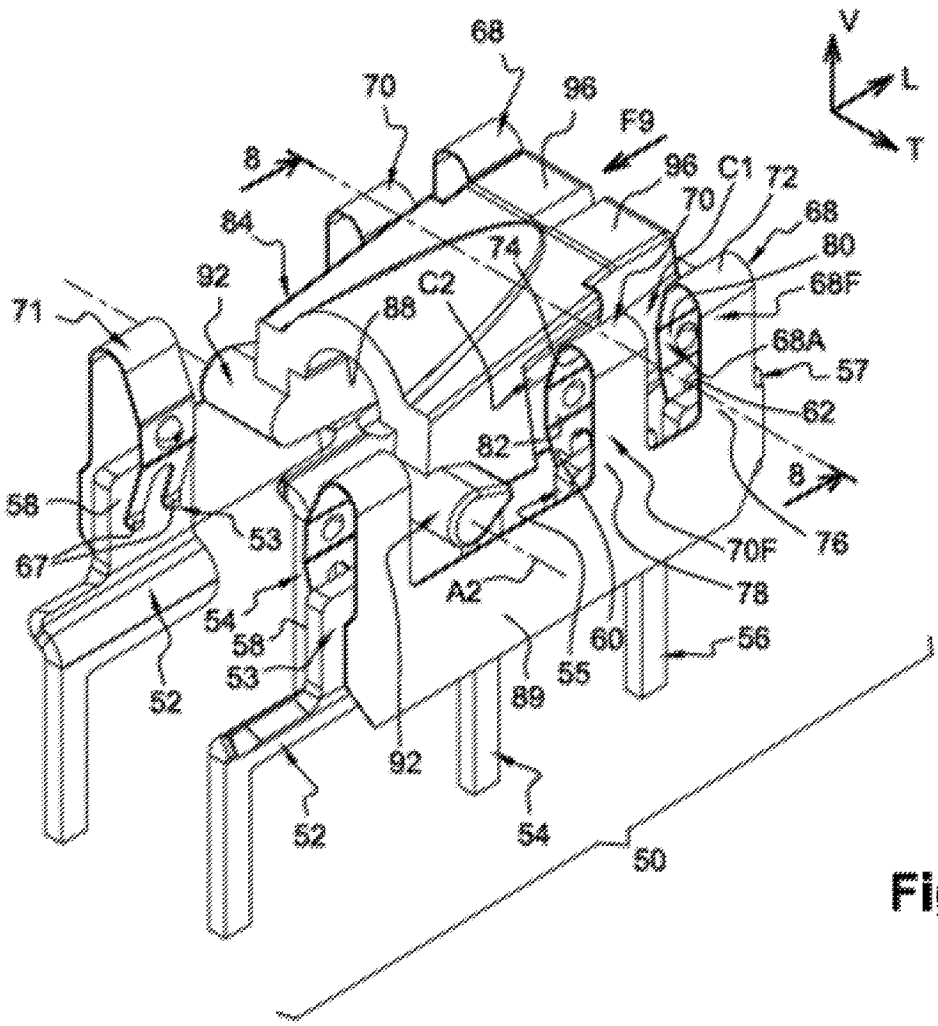
FIG. 7 is an enlarged perspective view of the fixed and movable contact elements in association with the driving member in its upper position.
Figure 8:
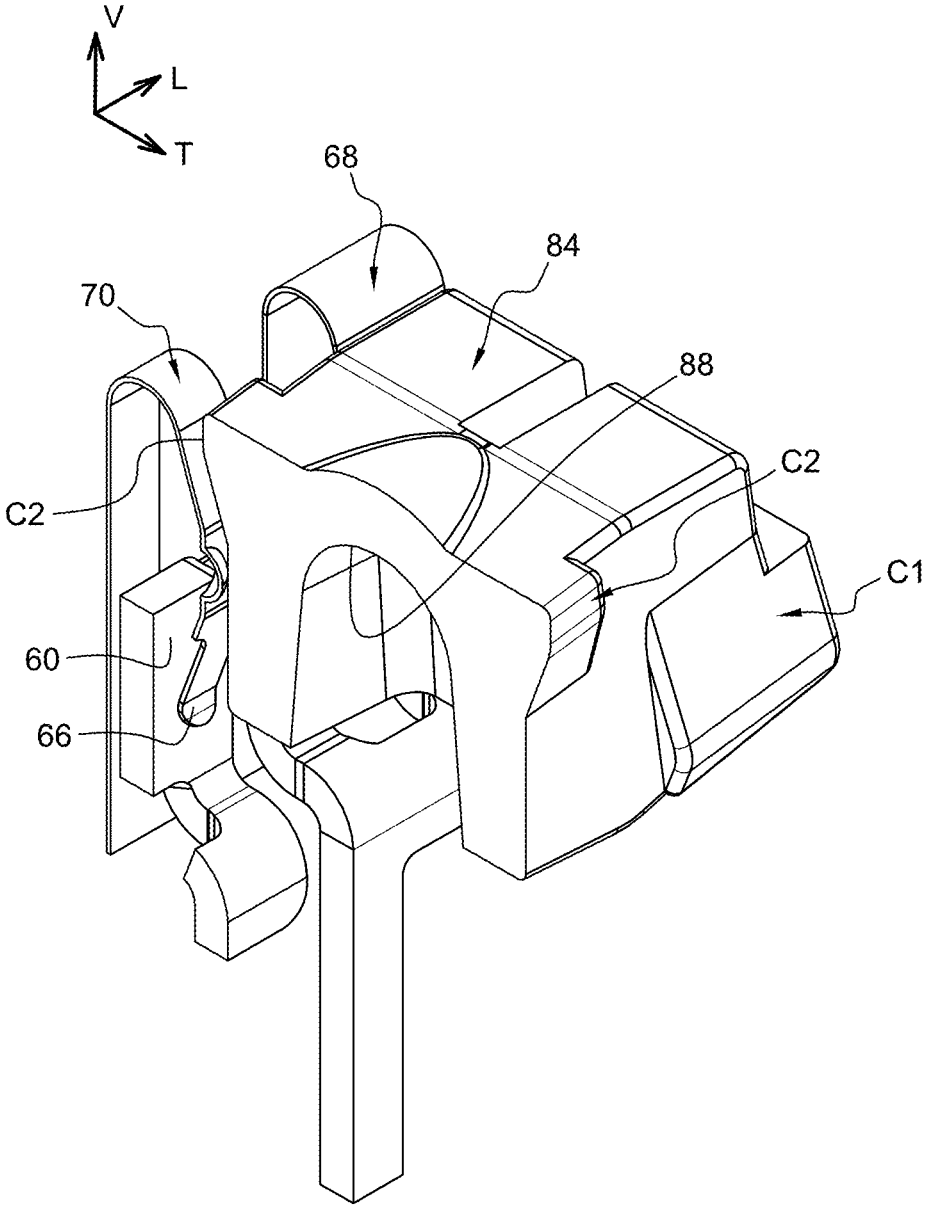
FIG. 8 is a cross section view taken along the vertical plane 8-8 of FIG. 7.

With reference to FIG. 7, the snap switch 10 comprises a conductive unit 50 that includes several conductive fixed contacts belonging to metallic fixed conductive pins made of a cut metal sheet. In one embodiment, the conductive unit comprises a pair of first conductive fixed contacts 56, each one comprising a first fixed upper contact zone 57, arranged inside the housing 12, in the form of a vertical and longitudinal contact plate. The two first upper contact plates 57 are transversely aligned in a vertical plane P1 (FIG. 3).

In one embodiment, the conductive unit comprises a pair of second conductive fixed contacts 54, each comprising a second fixed upper contact zone 55, arranged inside the housing 12, in the form of a vertical and longitudinal contact plate. The two second upper contact planes 55 are transversely aligned in a vertical plane P2 (FIG. 3).

In one embodiment, the conductive unit comprises a pair of third conductive fixed contacts 52, each comprising a fixed third upper contact zone 53, arranged inside the housing 12, in the form of a vertical and longitudinal contact plate. The two third upper contact plates 53 are transversely aligned in a vertical plane P3 (FIG. 3), which is arranged longitudinally close to the pushbutton switch 18, between the axis A1 and the transversal stem shaped portion 46.

Each contacting plate, 53, 55 or 57 defines a fixed contact face 58, 60 and 62 respectively which is oriented inwardly. As it can be seen at FIGS. 3, 5 and 9*a*-9*b*, on each lateral side, the fixed contact faces 60 and 62 extend substantially in the same vertical and longitudinal plane. Each fixed contact face 58 is slightly inwardly offset with respect to the common plane in which extend the faces 60 and 62 (see FIGS. 9*a*-9*b*).

The lower part 14 of the housing 12 is a plastic piece over moulded on the fixed contacts 50 and each fixed contact comprises a tail extending vertically outwardly for the electrical connection of the fixed contacts and of the snap switch 10, in a known manner, for instance on the upper face of a printed circuit board.

In one embodiment, with reference to FIGS. 7 and 4, each one of the first or second fixed contact zones 57/62 or 55/60 is associated with a first movable contact 64 and a second movable contact 66, respectively. The first and second movable contacts are arranged transversely facing the associated fixed contact zone.

Figure 9B:
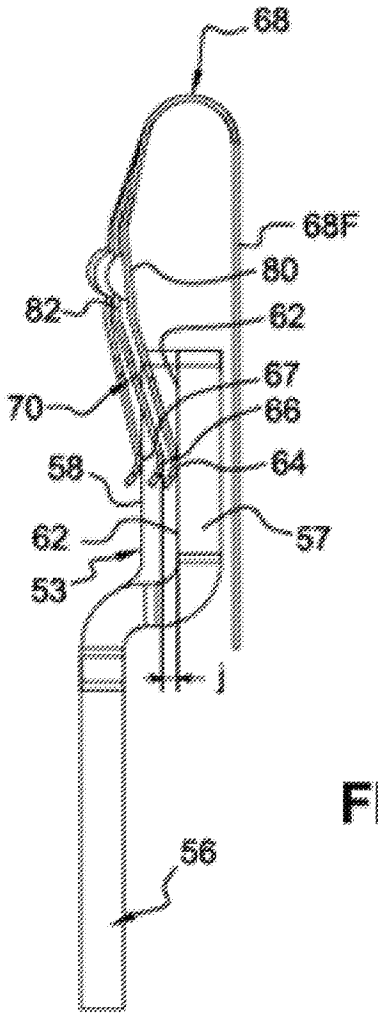
FIGS. 9(*a*) and 9(*b*) (hereinafter "FIG. 9") are longitudinal end views along the arrow F9 of FIG. 7, showing the fixed and movable contact elements.
Figure 9A:
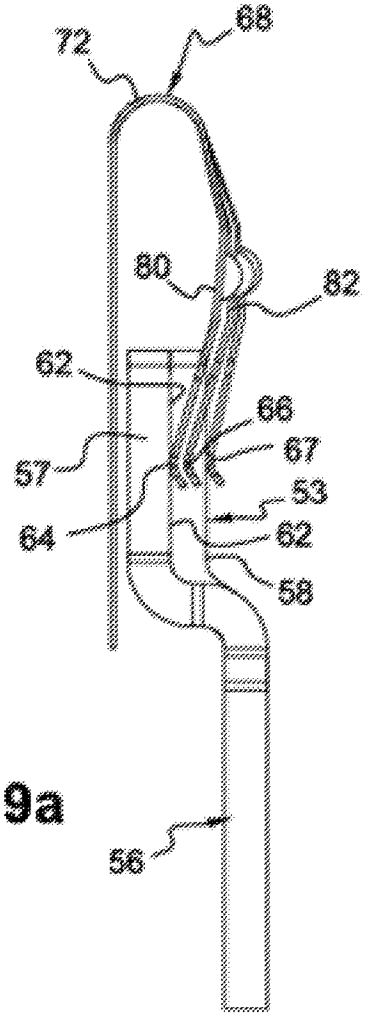

With reference to FIGS. 9*a*-9*b*, the first movable contact 64 is a movable portion, in the form of a fork, of a first elastically deformable conductive blade 68 that is supported by the lower part 14 of the housing 12. The second movable contact 66 is a movable portion, in the form of a fork, of a second elastically deformable conductive blade 70 that is supported by the lower part 14 of the housing 12. Each deformable contact blade 68, 70 is the form of a cut and bent sheet of conductive metal having a general shape of a hairpin.

With reference to FIG. 7, each deformable contact blade 68, 70 comprises two vertically oriented and globally parallel branches, each having a fixed branch 68F, 70F and an active branch 68A, 70A, both branches being connected by a 180° upper bent portion 72, 74 extending between the adjacent upper ends of the two branches 68F/68A and 70F/70A, respectively. Further, each fixed branch 68F, 70F extends vertically upwardly and has a lower end 76, 78 attached to the housing lower part 14. Each lower end 76, 78 of the fixed branch 68F, 70F is vertically inserted (forced fit) and fixed in a receiving portion of the lower part 14 of the housing 12. In a non-limiting manner, on each side, the lower ends 76, 78 of two adjacent fixed branches 68F, 70F are connected together by a longitudinal and vertical band 89.

With reference to FIGS. 9*a*-9*b*, each active branch 80, 82 extends downwardly and comprises an upper bent portion having its convexity transversely and inwardly oriented to constitute a cam follower portion, and a lower bent free end portion 64, 66 having its convexity transversely and outwardly oriented to constitute the movable contact portion.

In one embodiment, when the deformable contact blades 68, 70 are in a free state, i.e. when they are not elastically deformed, there is a play or gap "j" between a movable contact portion 64, 66 and its associated and facing face 62, 60 of the corresponding fixed contact plate 57, 55.

As it will be explained with reference to FIG. 7, each blade 68, 70 is deformable, under a transversal and horizontal pressure acting on the cam portion 80, 82, starting from its free non-active state towards a deformed and active state, in which the movable contact portion 64, 66 is in electrically conductive contact with a facing and associated fixed contact face 62, 60.

In the non-limiting example illustrated in the drawings, the two adjacent deformable blades 68 and 70 have a common output in the form of the band 89, which is also the lower connecting part for a permanently fixed contacting third blade 71. Each third blade 71 is shaped as the deformable active blades 68 and 70, but it is configured to have its lower free end portion 67 permanently in electrical contact with the contact face of the third contact plate 53. Consequently, the deformable blades 68 and 70 are electrically connected to the fixed contact 52.

When the first movable contact portion 64 is deformed and is in its active state for establishing a first conductive way, the contact 56 is electrically connected to the contact 52. When the second movable contact portion 66 is deformed and is in its active state for establishing a second conductive way, the contact 54 is electrically connected to the contact 52.

Figure 11:
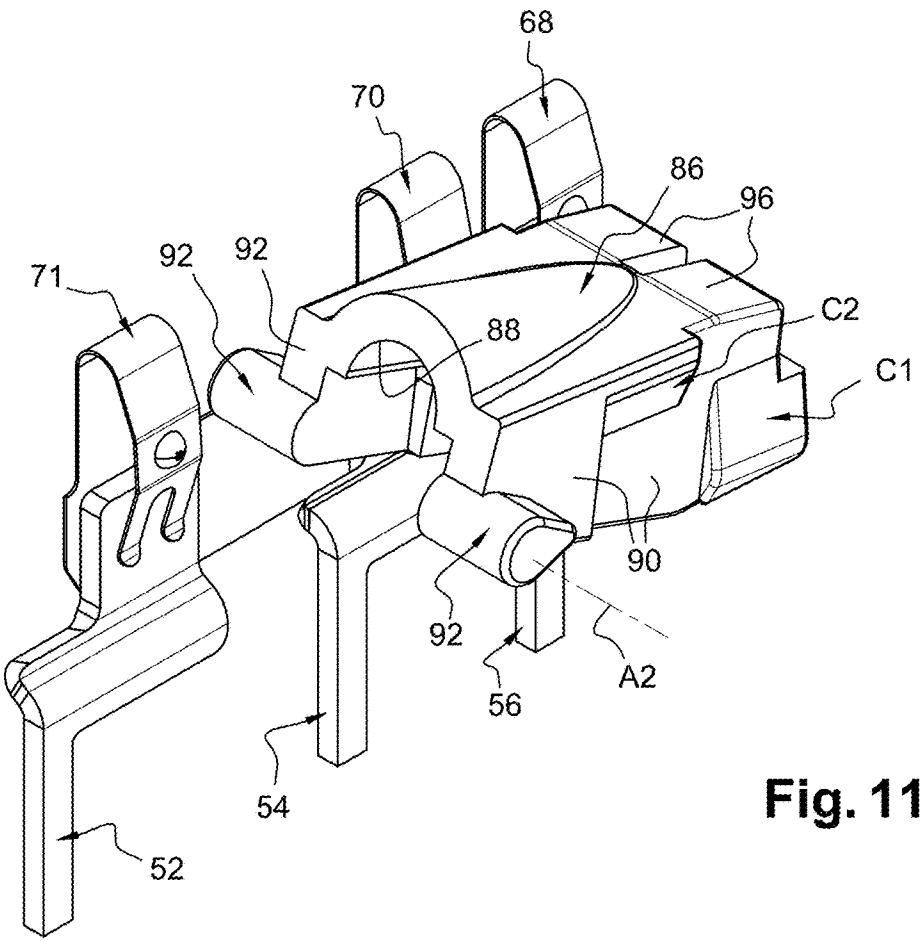
FIG. 11 is a view analogous to the view of FIG. 7 showing the driving member in its lower position.

Returning to FIG. 4, the control of the change of state of the movable contact portions 64 and 66 is further explained. In one embodiment, the snap switch 10 comprises a snap-action switching device comprising a tilting, or rocking or swaying driving member 84 which is pivotally mounted with respect to the housing 12 around a horizontal axis A2, and a traction spring 86. In one embodiment, the traction spring 86 is a helicoidally wounded traction spring. The driving member 84 is a non-conductive plastic moulded component in the form of a longitudinal yoke delimiting an internal longitudinal funnel 88 for receiving the traction spring 86. The driving member 84 is delimited by two opposed lateral longitudinal and vertical driving faces 90 (FIG. 11).

With reference to FIG. 3, at its longitudinal end proximal to the actuating portion 28 of the pushbutton 18, the driving element 84 comprises two aligned convex fulcrum portions 92, which extend transversely. Each fulcrum portion 92 is received in a complementary concave portion formed in the housing 12 for pivotally mounting the driving member 84 with respect to the housing 12 around a horizontal and transversal axis A2.

Returning to FIG. 4, the driving member 84 comprises a transverse stem shaped transverse portion 94 for hooking one end of the traction spring 86. The traction spring 86 has a first end 85 operatively connected to the portion 46 of the actuating portion 28 of the pushbutton, and a second opposed end 87 hooked to the portion 94 of the driving member 84.

In one embodiment, with further reference to FIG. 4, under the action of the traction spring 86 and of the return spring 36, the driving unit 84 and the pushbutton 18 can be in their "upper" rest positions. This upper position is defined by the cooperation between an upper face portion 96 of the driving member with an internal facing portion 98 of the upper cover part 16.

Figure 10:
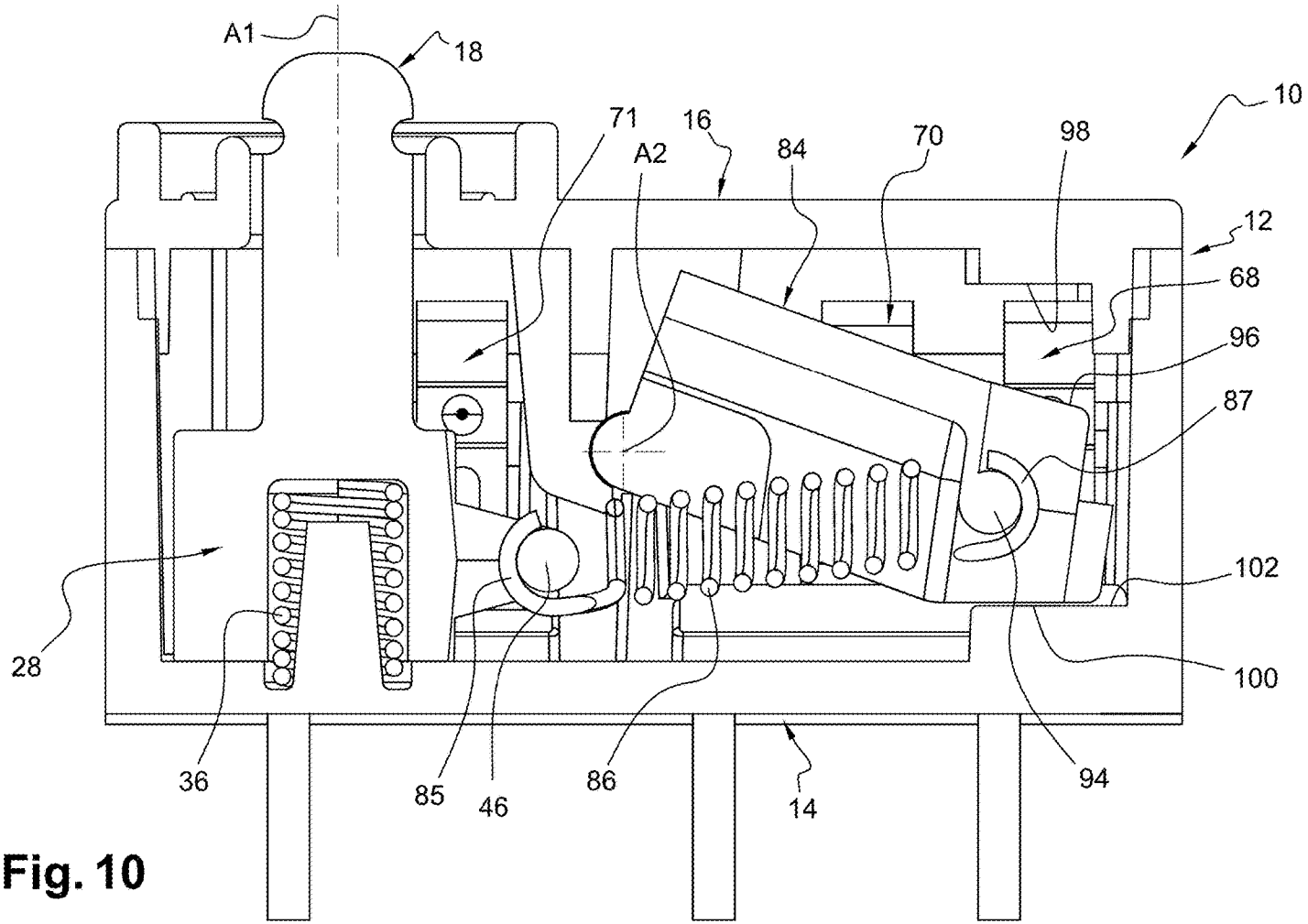
FIG. 10 is a cross-sectional view taken along line 4-4 of FIG. 3 showing the components in their lower position.

When the user pushes downwardly on the stem 22 of the pushbutton, the actuating portion 28 of the pushbutton 18 acts, by means of the portion 46, on the first end 85 of the traction spring 86 to provoke the pivoting of the driving member 84, around the fixed horizontal axis A2, towards its second "lower" position illustrated at FIG. 10. This lower position is defined by the cooperation between a lower face portion 100 of the driving member 84 with an internal facing portion 102 of the lower part 14 of the housing 12.

With reference to FIG. 11, for selectively acting on the deformable blades 68 and 70, each lateral driving face 90 comprises two adjacent protruding driving cams, i.e. a first cam C1 and a second cam C2.

Turning to FIG. 7, the first cam C1 is dimensioned and designed for cooperating with the cam follower portion 80 of the first deformable blade 68. When the driving member 84 is in its upper position (in which the first end of the traction spring is in an upper spring position), the first cam C1 is permanently acting on the associated first cam follower portion 80 and the first conductive path is established. When the driving member 84 is in its lower position (in which the first end of the traction spring is in a lower spring position), the first cam C1 is no longer acting on the first cam follower portion 80 and the first conductive path is no longer established.

The second cam C2 is dimensioned and designed for cooperating with the second cam follower portion 82 of the second deformable blade 70. When the driving member 84 is in its upper position, the second cam C2 is not acting on the second cam follower portion 82 and the second conductive way is not established. When the driving member 84 is in its lower position, the second cam C2 is permanently acting on the associated second cam follower portion 82 and the second conductive path is established.

When the user pushes downwardly on the stem 22 of the pushbutton, the actuating portion 28 of the pushbutton 18 acts to pivot the driving member 84 from its upper position to its lower active position. Such pivoting of the driving member from its upper active position towards its lower active position provokes a simultaneous change of the state of the first conductive path (passing from an "ON" status to an "OFF" status) and of the second conductive path (passing from an "OFF" status to an "ON" status). This change of position provokes the switching, i.e. the simultaneous interruption of the two first conductive paths—between the fixed contacts 52 and 56, and the subsequent simultaneous establishment of the two second conductive paths between the fixed contacts 52 and 54. It also provokes the compression of the return spring 36.

When the user releases its actuation effort on the stem 22, the previously compressed return spring 36 acts upwardly on the pushbutton 18 to push it vertically and upwardly. The actuating portion 28 of the pushbutton 18 acts to pivot the driving member 84 from its lower to its upper position. Depending on the upper or lower position of the driving member 84, each cam may or may not cooperate with an associated cam follower portion of an associated elastically deformable blade to deform, or to relax, said blade for establishing or interrupting the associated conductive path.

The embodiments described above use a "caming" driving member to enable over travel of actuation. Manufacturing costs can also be reduced. In one embodiment, various fixed and movable contact elements can be fixed to and supported by the plastic moulded housing. Alternatively or additionally, the driving member can also be plastic moulded. Further, the tilting or swaying member does not comprise any metallic current conductive portion or element. Durability problem can also be solved because no sliding contacts are used.

As would be appreciated to a person ordinarily skilled in the art, the various embodiments disclosed in this document permit any variations in the arrangement of the establishment and interruption of conductive paths, such as in different position and in different number. These embodiments also permit use in and variations adapted for different applications. For example, the disclosed switch can be used in the automotive industry for actuation of an electronic parking brake. This switch may also be used in many applications including automotive air-bag systems as the system shut off switch. This switch can be used in any electronics application which, for instance, requires a double pole double throw circuit particularly if fast switching of both poles is desired.

Figure 13:
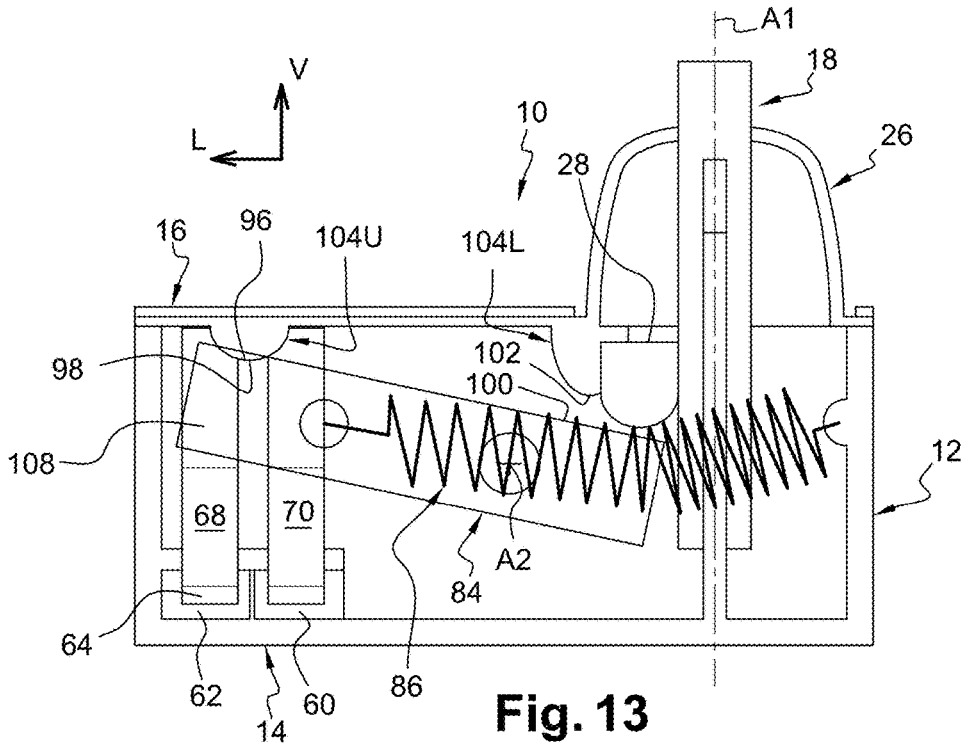
FIGS. 13 and 14 are simplified schematic views similar to the views of FIGS. 7 and 11 showing another example of a snap switch according to one embodiment.
Figure 14:
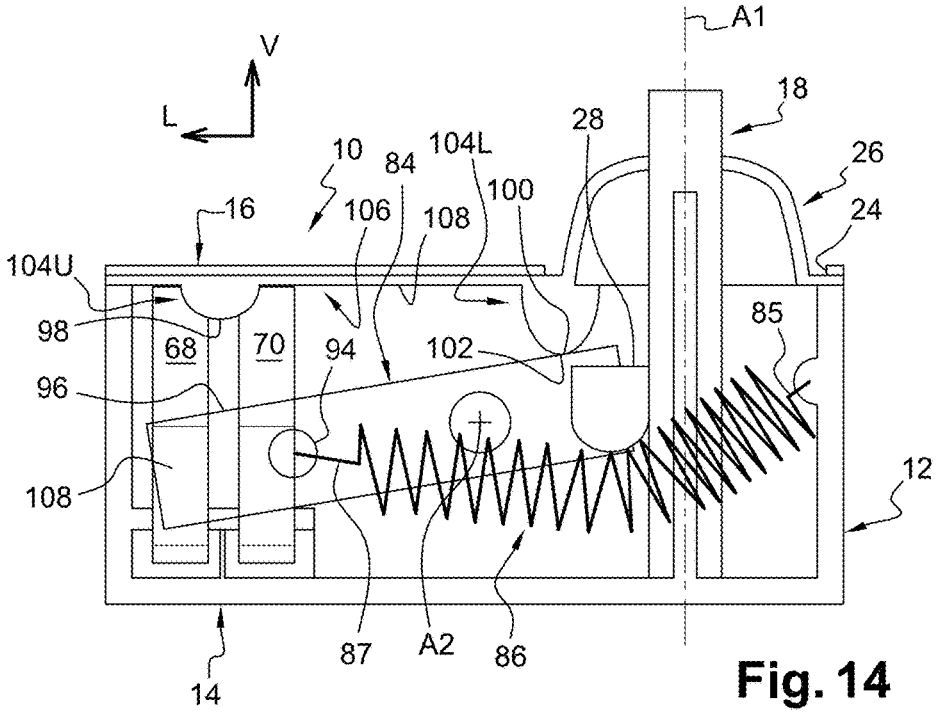

In one embodiment, with reference to FIGS. 13 and 14, the return spring 36 can be optional, and instead, the actuating portion 28 is acting directly on the body of the traction spring 86, which has thus double function acting on the pushbutton 18 and on the driving member 84. The end 85 of the traction spring 86 can be hooked on the housing.

In one embodiment, the switch comprises an integrated damping device in order to reduce the noise generated by the driving member 84 when it reaches its upper position or its lower position, and the impacts on the facing part or portion of the housing. With further reference to FIGS. 13 and 14, the damping device comprise two elastic dampening abutment blocks 104U and 104L, respectively, for defining the upper and the lower position of the driving member 84. This permits to have the two dampening blocks on the same side of the driving member and thus to integrate the two abutment dampening blocks in a common "dampening" component.

By way of example, the two blocks, together with the sealing boot 26 can be integrated in a one piece dampening, and sealing component 106 can be made of silicon or rubber or elastomer in the shape of a horizontal sealing sheet 108 and extending on all the area of the cover 16, so that it is vertically interposed between the upper edge of the lower housing part 14 and the under face of the cover part 16. Beyond the transverse portion 94 for hooking the end 87 of the traction spring 86, the driving member 84 includes an extension 108, which cooperates with the block 104U when the driving member is in its upper position. Further, the driving member includes an extension 100, which cooperates with the block 104L when the driving member is in its lower position.

Alternatively and/or additionally, it is also possible to integrate the dampening abutment blocks 104U and 104L directly with the body of driving member 84, for example in the zones 96 and 100 of the driving member 84. Since the above disclosed embodiments of conductive paths and the arrangements of the contacts permit over travel without affecting the operation, it is possible to determine the two positions of the driving member 84 by means of non-rigid abutments such as the dampening abutment blocks 104U and 104L.

As will be appreciated by any person ordinarily skilled in the art, the arrangement of the above disclosed dampening device is not limited to a snap switch having aforementioned contacts arrangement. The dampening device may apply to any snap switch of the type comprising a housing and a driving member defining abutment zones that are configured to cooperate with associated abutment zones of the housing.

The above-disclosed features and functions, as well as alternatives, may be combined into many other different systems or applications. Various presently unforeseen or unanticipated alternatives, modifications, variations or improvements may be made by those skilled in the art, each of which is also intended to be encompassed by the disclosed embodiments.

The invention claimed is:

1. An electrical snap switch comprising:

a housing defining a receiving portion;

a pushbutton having a lower portion disposed in the housing and an upper portion extending out of the housing, wherein the pushbutton comprises an actuating portion laterally extending from the lower portion of the pushbutton, and wherein the pushbutton is configured to move vertically relative to the housing between a pushbutton upper active position and a pushbutton lower active position when an external force is applied to the pushbutton;

at least a first pair of associated contact elements disposed in the receiving portion, the at least a first pair of associated contact elements comprising:

a first fixed contact element disposed in the receiving portion, and a first movable contact element facing the first fixed contact element and configured to come into contact with the first fixed contact element for establishing a first conductive path between the first movable contact element and the first fixed contact element; and a snap-action switching device disposed in the receiving portion, the snap-action switching device comprising:

a tilting driving member pivotally mounted at a pivotal end to the housing around an horizontal axis, the tilting driving member having a distal end distal to the pivotal end, and a traction spring extending longitudinally and having a first longitudinal end hooking to the distal end of the driving member and configured to pivot the driving member between an upper position and a lower position by the actuating portion of the pushbutton when the pushbutton moves vertically relative to the housing;

wherein the first movable contact element is a movable portion of a first elastically deformable conductive blade supported by the housing, and wherein the driving member comprises a first cam configured to cooperate with a cam follower portion of the first blade to deform or relax the first blade transversely to move the first movable contact element to come into contact or release from contact with the first fixed contact element.

2. The electrical snap switch of claim 1, wherein:

the cam follower portion comprises a bent portion of the first blade having a convexity oriented inwardly towards a longitudinal and vertical driving face of the driving member; and the first cam is disposed on the driving face.

3. The electrical snap switch of claim 1, wherein the movable portion is a free end portion of the first blade.

4. The electrical snap switch of claim 1, wherein:

the first blade is in the form of a hairpin and comprises a vertically upwardly extending fixed branch having a lower end attaching to the housing, and a vertically active branch extending vertically downwardly from an upper end of the fixed branch; and the cam follower portion and the movable portion are disposed on the active branch.

5. The electrical snap switch of claim 1, wherein the movable portion is a bent portion of the first blade having a convexity oriented outwardly towards an associated first fixed contact element.

6. The electrical snap switch of claim 1 further comprising:

a second pair of associated contact elements disposed in the receiving portion of the housing, the second pair of associated contact elements comprising:

a second fixed contact element disposed in the receiving portion, and a second movable contact element facing the second fixed contact element and configured to come into contact with the second fixed contact element for establishing a second conductive path between the second movable contact element and the second fixed contact element;

wherein the second movable contact element is a movable portion of a second elastically deformable conductive blade supported by the housing;

wherein the driving member comprises a second cam configured to cooperate with a cam follower portion of the second blade to deform or relax the second blade transversely to move the second movable contact element to come into contact or release from contact with the second fixed contact element; and wherein the first and second fixed contact elements are disposed in the receiving portion longitudinally side by side at an interval.

7. The electrical snap switch of claim 6, wherein when the driving member is in its upper or lower position, one of the first and second conductive paths is established and the other conductive path is interrupted.

8. The electrical snap switch of claim 1, wherein the tilting driving member is pivotally mounted with respect to the housing around a geometrical horizontal pivoting axis that is fixed with respect to the housing.

9. The electrical snap switch of claim 1, wherein when the first cam cooperates with the associated cam follower portion, the associated movable portion of the associated conductive blade is maintained into contact under pressure with the facing fixed contact element.

10. The electrical snap switch of claim 1, wherein the housing is symmetrical with respect to a vertical median plane.

11. The electrical snap switch of claim 1, wherein:

the housing has a lower housing part and an upper cover, and the upper position of the driving member is defined by a cooperation of an upper face portion of the driving member with an internal facing portion of the upper cover;

the lower position of the driving member is defined by a cooperation of a lower face portion of the driving member with an internal facing portion of a lower part of the housing;

at least one of the face portions defining the upper position of the driving member has a first elastic dampening abutment block disposed thereon; and at least one of the face portions defining the lower position of the driving member has a second elastic dampening abutment block disposed thereon.

12. The electrical snap switch of claim 11, wherein at least one of the first and second elastic dampening abutment blocks is part of the housing.

13. The electrical snap switch of claim 11, wherein at least one of the first and second elastic dampening abutment blocks is part of the driving member.

14. The electrical snap switch of claim 11, wherein the first and second elastic dampening abutment blocks are disposed on a same upper side or lower side with respect to the driving member.

15. The electrical snap switch of 13, wherein the first and second elastic dampening abutment blocks are integral with a single dampening component.

16. The electrical snap switch of claim 11, further comprising a sealing sheet interposed between the upper cover and the lower part of the housing, wherein the sealing sheet is made of elastically deformable material, and wherein at least one of the first and second dampening abutment blocks is integral with the sealing sheet.

17. The electrical snap switch of claim 1, wherein the traction spring has a second longitudinal end opposite to the first longitudinal end and the second longitudinal end hooks to the actuation portion of the pushbutton.

18. The electrical snap switch of claim 17, wherein the second longitudinal end of the traction spring hooks to the actuation portion of the pushbutton via a transversal stem extending from the actuation portion.

19. An electrical snap switch comprising:

a housing having a receiving portion;

a pushbutton having a lower portion disposed in the housing and an upper portion extending out of the housing, wherein the pushbutton comprises an actuating portion laterally extending from the lower portion of the pushbutton, and wherein the pushbutton is configured to move vertically relative to the housing between a pushbutton upper active position and a pushbutton lower active position when an external force is applied to the pushbutton;

at least a first pair of associated contact elements disposed in the receiving portion, the at least a first pair of associated contact elements comprising:

a first fixed contact element disposed in the receiving portion, and a first movable contact element facing the first fixed contact element and configured to come into contact with the first fixed contact element for establishing a first conductive path between the first movable contact element and the first fixed contact element; and a snap-action switching device disposed in the receiving portion, the snap-action switching device comprising:

a tilting driving member pivotally mounted at a pivotal end to the housing around an horizontal axis, the tilting driving member having a distal end distal to the pivotal end, and a traction spring extending longitudinally and having a first longitudinal end hooking to the distal end of the driving member, a second longitudinal end hooking to an interior side of the housing, and configured to pivot the driving member between an upper position and a lower position by the actuating portion of the pushbutton when the pushbuttons moves vertically relative to the housing;

wherein the first movable contact element is a movable portion of a first elastically deformable conductive blade supported by the housing, and wherein the driving member comprises a first cam configured to cooperate with a cam follower portion of the first blade to deform or relax the first blade transversely to move the first movable contact element to come into contact or release from contact with the first fixed contact element.

20. The electrical snap switch of claim 19, wherein the tilting driving member is pivotally mounted with respect to the housing around a geometrical horizontal pivoting axis that is fixed with respect to the housing.

* * * * *